US009188904B2

(12) United States Patent
Luke

(10) Patent No.: US 9,188,904 B2
(45) Date of Patent: Nov. 17, 2015

(54) TONER SUPPLY REGULATION

(71) Applicant: HEWLETT-PACKARD DEVELOPMENT COMPANY, L.P., Houston, TX (US)

(72) Inventor: Jeffrey Harold Luke, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 51 days.

(21) Appl. No.: 13/754,230

(22) Filed: Jan. 30, 2013

(65) Prior Publication Data

US 2014/0212154 A1 Jul. 31, 2014

(51) Int. Cl.
*G03G 15/08* (2006.01)
*G03G 15/00* (2006.01)

(52) U.S. Cl.
CPC ..... *G03G 15/0856* (2013.01); *G03G 15/556* (2013.01); *G03G 15/0863* (2013.01)

(58) Field of Classification Search
CPC G03G 15/08; G03G 15/0865; G03G 15/0879
USPC ..... 399/258–260, 252, 263
See application file for complete search history.

(56) References Cited

U.S. PATENT DOCUMENTS

| | | | | |
|---|---|---|---|---|
| 3,918,402 | A * | 11/1975 | Ohta | 399/267 |
| 5,430,532 | A * | 7/1995 | Ueda et al. | 399/263 |
| 6,473,587 | B2 | 10/2002 | van Woerkens | |
| 7,583,916 | B2 | 9/2009 | Ogata et al. | |
| 7,603,065 | B2 * | 10/2009 | Yamaguchi et al. | 399/258 |
| 7,657,194 | B2 * | 2/2010 | Tanaka et al. | 399/30 |
| 2005/0117919 | A1 * | 6/2005 | Ito et al. | 399/27 |
| 2008/0095553 | A1 * | 4/2008 | Tanaka et al. | 399/263 |
| 2010/0232815 | A1 | 9/2010 | Zheng | |
| 2011/0110689 | A1 | 5/2011 | Hirayama et al. | |

FOREIGN PATENT DOCUMENTS

JP 2010281928 A 12/2010

OTHER PUBLICATIONS

Xiao, F.F; "Permanent Magnets in Xerographic Systems"; Sep. 2000; http://www.google.com/url?sa=t&rct=j&q=&esrc=s&source=web&cd=11&ved=0CJ8DEBY.

* cited by examiner

*Primary Examiner* — Clayton E Laballe
*Assistant Examiner* — Ruifeng Pu
(74) *Attorney, Agent, or Firm* — Hewlett-Packard Patent Department

(57) ABSTRACT

An electro-photographic print system or method for regulating a supply of toner based on a required toner amount.

21 Claims, 5 Drawing Sheets

TONER SUPPLY REGULATION

BACKGROUND

Dry toner cartridges can include toner reservoirs, toner resupply rollers, developer rollers and organic photoconductor (OPC) rollers. Toner cartridges can be provided with a developer blade that squeezes toner against the developer roller. In some examples, stirring mechanism stir toner within the reservoir to aid in the flow of toner towards the rollers.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. In different examples, similar reference numbers are used for similar or identical parts. The examples in the description and drawings should be considered illustrative and are not to be considered as limiting to the specific example or element described. Multiple examples may be derived from the following description and/or drawings through modification, combination or variation of certain elements.

Figure 1:
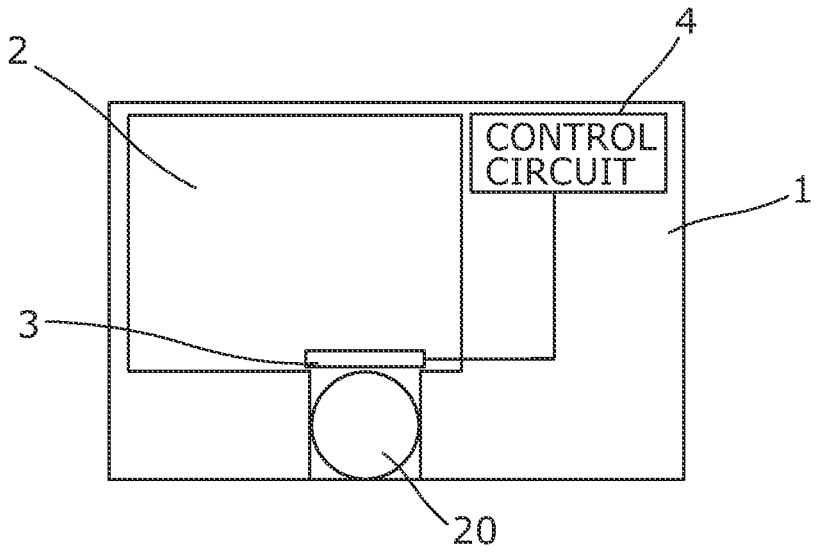
FIG. 1 illustrates a diagram of an example of an electrophotographic print system.

FIG. 1 illustrates a diagrammatic example of an electrophotographic print system 1. The print system 1 includes a toner reservoir 2. In filled condition the toner reservoir 2 contains dry toner. The print system 1 includes a toner supply roller assembly 20 for transferring toner from the reservoir 2 to media. The electro-photographic print system 1 includes a toner supply regulator 3 for regulating the supply of toner from the reservoir 2 to the toner roller assembly 20. For example the toner supply regulator 3 is to meter the toner out of the reservoir 2. For example the toner supply regulator 3 includes at least one of a valve, gate, dry pump, stirring device or any suitable mechanism to stimulate movement of toner to the toner roller assembly 20.

In one example the print system 1 includes or is defined by a replaceable toner cartridge. In another example, the print system 1 includes a printer and a toner cartridge that is replaceable with respect to the printer. In another example the print system 1 includes a printer and a toner reservoir fixed within the printer.

The print system 1 includes a control circuit 4. For example, the control circuit 4 is provided in one of the cartridge and the printer. The control circuit 4 is to calculate a required toner amount, which is a toner amount required to print.

For example, the required toner amount can be determined or estimated from the digital print job before, during or after printing the print job. For example, the required toner amount can be based on a detected toner amount that is present in or near the toner supply roller assembly 20, for example by detecting such amount with a sensor. If a toner level near the toner supply roller assembly 20 is low, then the required toner amount can be calculated to be high. In another example the required toner amount can be based on toner coverages of printed or to be printed pages. For example if the toner coverage of printed or to be printed pages is high, then the required toner amount can be determined to be high. For example the required toner amount can be determined for each color separately. The control circuit 4 is to instruct the toner supply regulator 3 to regulate toner based on the required toner amount. If a relatively high required toner amount is calculated, the control circuit 4 instructs the toner supply regulator 3 to supply toner out of the reservoir 2 to the toner supply roller assembly 20. For example, when pages with high coverage are being printed, the toner supply regulator 3 is to ensure sufficient supply of toner to the toner supply roller assembly 20. When a relatively low required toner amount is detected, the control circuit 4 instructs the toner supply regulator 3 to close the passageway to the toner supply roller assembly 20. When low toner amounts are required it may be permitted to temporarily inhibit supply of toner to the toner supply roller assembly 20. By inhibiting movement of toner in and out of the reservoir 2, wear of toner particles for example by stirring, squeezing or collision is decreased. Decreasing wear during printing can have a positive effect on long term quality of the toner in the print system 1.

Different example systems and processes can be used as input for the control circuit 4 to calculate required toner amounts. For example capacitive plate sensors can be applied, wherein plates are arranged near a toner sump, the plates forming a capacitor to measure a change in capacitance when toner passes, the change in capacitance being an indicator of discharged toner amounts. Another example sensing system is a light pipe sensor, including a light source and a light receptor for detecting light changes indicative of toner level. Yet another sensing system includes pixel counting software or firmware, wherein image data is analyzed to determine toner coverage of predetermined pages. Again other example techniques sum the times that a laser is switched on, which corresponds to toner usage. Again another example of a sensing system is a toner amount sensor near the toner supply roller assembly 20 and will be explained with reference to FIGS. 3 and 4. The example sensing systems can be used separately or in combination.

Figure 2:
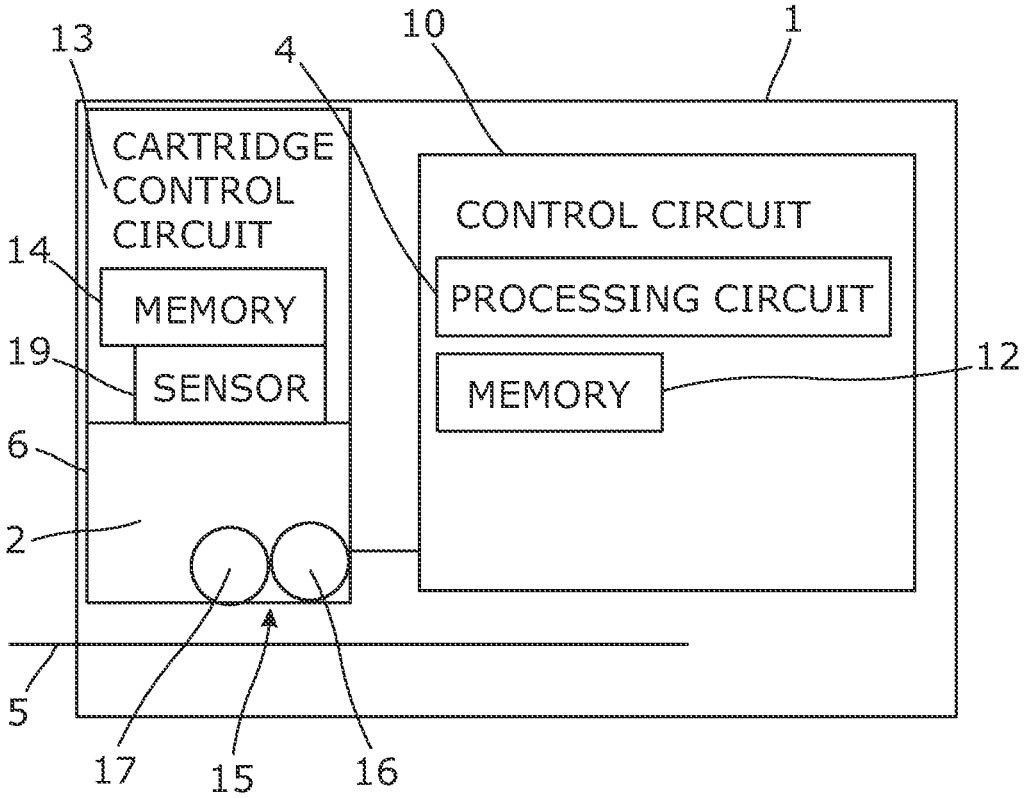
FIG. 2 illustrates a diagram of another example of an electro-photographic print system.

FIG. 2 illustrates a diagram of another example of an electro-photographic print system 1. In the example the print system 1 includes a toner cartridge 6, having a reservoir 2. For example, the print system 1 includes a printer control circuit 10. For example the printer control circuit 10 includes a processing circuit 10A and a memory 12. The printer control circuit 10 can be an application specific integrated circuit, for example including a formatter or controller for controlling printer and/or cartridge operations. For example the printer control circuit 10 includes an application specific integrated circuit to process image data and instruct the printer drive system and the toner supply roller assembly 20 and/or a gear train 17 for driving cartridge gears 16, 17.

For example, the cartridge 6 includes a cartridge control circuit 13. For example the cartridge control circuit 13 includes a memory 14. In other examples, the cartridge control circuit 13 includes a microcontroller and the memory 14 is part of the microcontroller. For example the cartridge control circuit 13 includes a processing circuit. When the cartridge 6 is installed in the printer the cartridge control circuit 13 is connected to the printer control circuit 10 by physical or wireless connection. For example, the cartridge control circuit 13 includes or is connected to a toner sensor 19 to sense toner amounts in the reservoir 2 and/or in or near the toner supply roller assembly 20. One of the printer or cartridge control circuit 10, 13 can control the toner supply regulator.

For example the cartridge 6 includes a cartridge transmission. For example, the cartridge transmission includes a gear train 15. For example when the cartridge 6 is installed the gear train 15 engages a corresponding printer drive system to transmit movement of the printer drive system to the toner supply roller assembly (illustrated in FIG. 1 and FIGS. 3-5) and internal cartridge elements such as a stir device and a toner supply regulator. For example the cartridge gear train 15 includes a stir device gear 16 for actuating a stir device, and a toner supply regulator gear 17 for actuating a regulator. For example, the gear train is instructed by the control circuit 10, 13 for example by a formatter.

In another example, the cartridge 6 includes an independent drive for driving the stir device gear 16 or the toner supply regulator gear 17. For example such independent drive is instructed by the cartridge control circuit 13 or printer control circuit 10.

Figure 3:
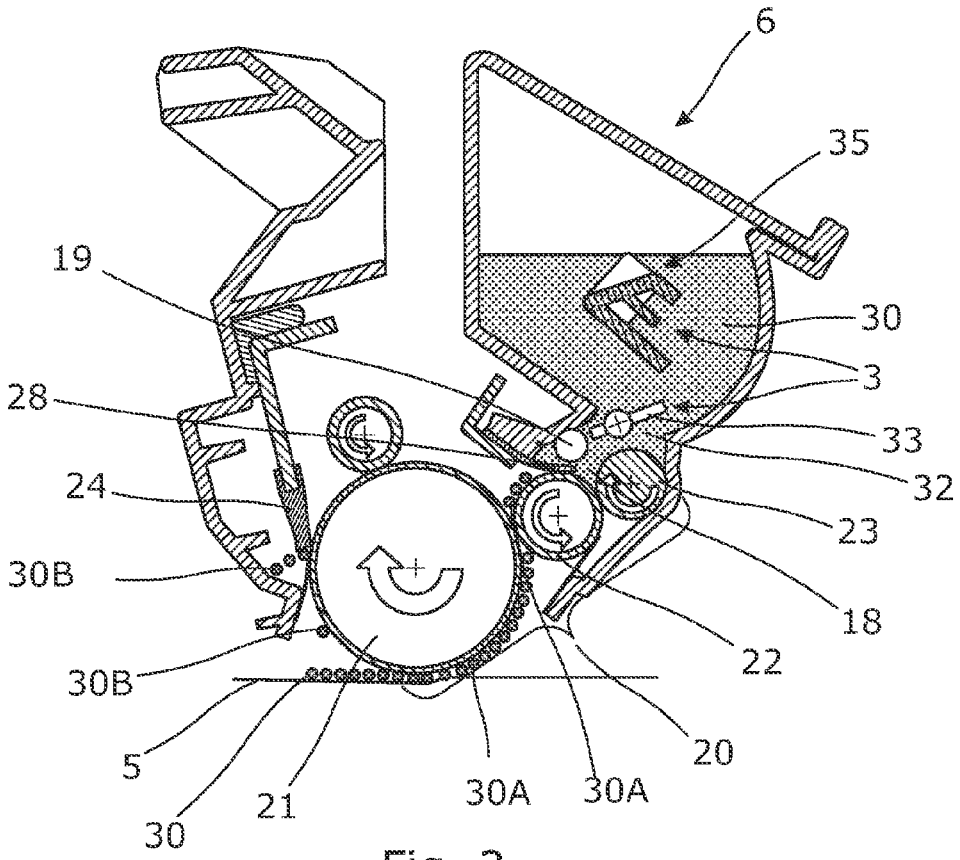
FIG. 3 illustrates a diagram of a cross sectional side view of an example of a toner cartridge during printing, wherein a passageway is open.
Figure 4:
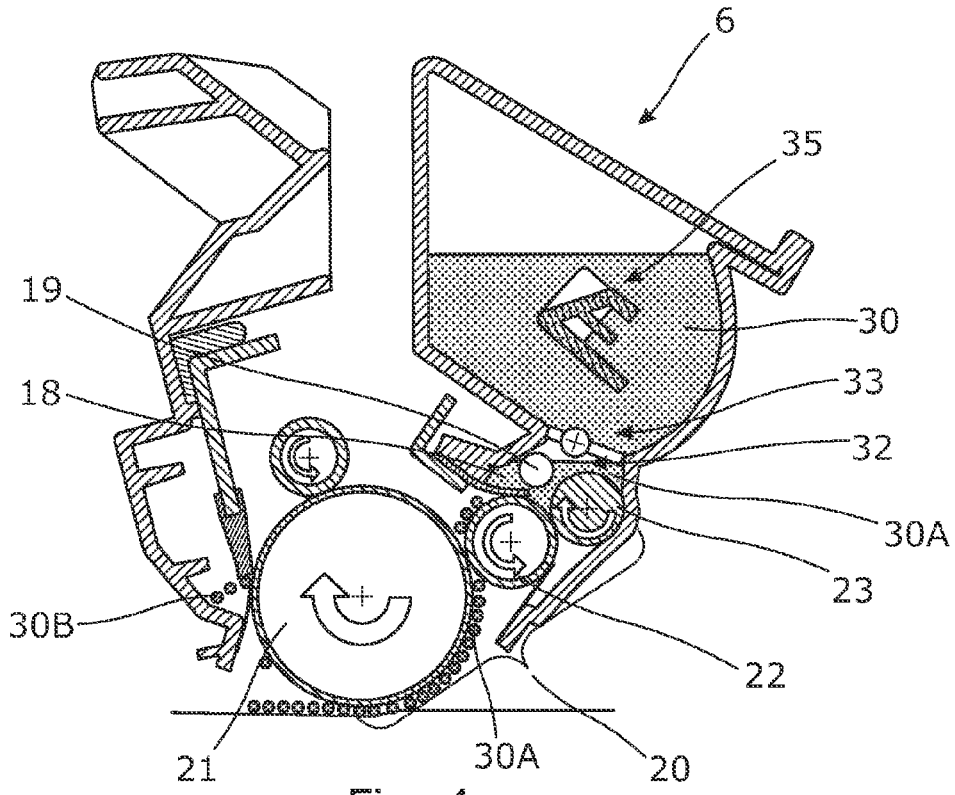
FIG. 4 illustrates a diagram of a cross sectional side view of the example toner cartridge of FIG. 3, also during printing, wherein a passageway is closed.

FIG. 3 illustrates another example of a print system. Here the illustrated print system is defined by a toner cartridge 6. The toner cartridge 6 is a fixed or exchangeable electrophotographic print system sub-assembly for containing and transferring toner 30, 30A. In the illustrated state the toner cartridge transfers toner 30, 30A out of the reservoir 2 to media 5. A printer in which the cartridge 6 can be mounted is not illustrated. In FIGS. 3 and 4, toner 30 in the reservoir 2 is indicated by reference number 30, toner 30A near or in the toner supply roller assembly 20 is indicated by reference number 30A, and waste toner is indicated by reference number 30B.

For example, the toner cartridge 6 includes a toner supply roller assembly 20. For example the toner supply roller assembly 20 includes an organic photoconductor roller 21 for transferring the toner image. A laser assembly (not illustrated) is to charge the photoconductor roller 21 based on image data processed by the control circuit 4. For example, the toner supply roller assembly 20 includes a developer roller 22 for charging the toner 30A before transfer to the photoconductor roller 21. For example, a squeeze blade 28 is provided for squeezing the toner 30A against the developer roller 22. For example, the toner supply roller assembly 20 includes a resupply roller 23 for aiding in the supply of toner out of the reservoir 2 to the developer roller 22. For example, the toner cartridge 6 includes a cleaning device such as a cleaner blade 24. For example the cleaning device cleans off waste toner 30B from the photoconductor roller 21. For example, the toner cartridge 6 includes a discharge or charge roller 25 for discharging or charging, respectively, the photoconductor roller 21. In further examples a transfer roller (not illustrated) is provided for transferring the toner image from the photoconductor roller 21 to the media 5.

The toner cartridge 6 includes a toner passageway 32 from the toner reservoir 2 to the toner supply roller assembly 2. For example the reservoir 2 includes a hopper and the passageway 32 is arranged at the bottom of said hopper. For example the reservoir includes converging walls near the passageway 32 to guide the toner 30 towards the passageway 32. For example the passageway 32 guides the toner 30 to the re-supply roller 23. For example, the toner cartridge 6 includes a toner supply regulator 3 for regulating the supply of toner 30 to the passageway 32. For example the regulator 3 includes a stir device 35 within the reservoir 2 and a gate structure 33 near or in the passageway 32.

For example, the gate structure 33 is to open and dose the toner passageway 32. For example the gate structure 33 includes a door or valve, arranged in or near the passageway 32 for opening and dosing the passageway 32. For example the passageway 32 and gate structure 33 are arranged at the bottom of the reservoir 2. For example the passageway 32 and gate structure 33 are located dose to the toner supply roller assembly 20.

In a further example the gate structure 33 is arranged near the toner resupply roller 23, for example just above the toner resupply roller 23. In another example, the gate structure 33 is arranged near the developer roller 22, for example just above the developer roller 22. For example high mechanical wear tends to occur near the developer roller 22 and/or the toner resupply roller 23, and can be prevented by disposing the regulating gate structure 33 near the developer roller 22 or toner resupply roller 23. The high mechanical wear near those parts can be explained by the collision and compression of the toner 30A near the moving parts such as the rollers 22, 23 and squeeze blade 28 in a relatively tight space.

For example the gate structure 33 includes a door or valve. In the illustrated diagrammatic example the gate structure 33 includes a hinge 34 for opening and closing the door. In other examples the gate structure 33 includes a sliding or rotating arrangement to open and close the passageway 32. In the example of FIG. 3 the gate structure 33 is open so that toner 30 can flow to the toner supply roller assembly 20 relatively freely. In the example of FIG. 4 the gate structure 33 is closed so that toner 30 cannot flow to the toner supply roller assembly 20.

For example the control circuit is to instruct the gate structure 33 to open the passageway 32 when the required toner amount is determined to be relatively high. For example the control circuit is to instruct the gate structure 33 to close the passageway 32 when the required toner amount is determined to be relatively low. For example during the printing of high coverage pages the passageway 32 is open so that toner 30 is continuously supplied to the toner supply roller assembly 20 through the passageway 32. For example during printing of low coverage pages the passageway 32 is closed so that toner 30 in the reservoir 2 is impeded from flowing to the toner supply roller assembly 20. The toner 30A in and near the toner supply roller assembly 20 is used to print the low coverage pages without adding toner 30 from the reservoir 2. Hence, the toner particles 30 in the reservoir 2 will be prevented from squeezing and colliding so that wear can be decreased.

For example, the toner cartridge 6 includes a sensor 19 to detect a toner level in or near the toner supply roller assembly 20. For example the sensor 19 is to detect an amount of toner 30A in a region 18 downstream of the gate structure 33, for example in a region 18 between the gate structure 33 and the developer roller 22. In other examples the sensor 19 is to detect if toner is present near at least one of the other rollers 21, 23 of the toner roller assembly 20. The sensor 19 can be any suitable type of sensor, for example an impedance sensor, a resistive sensor, an optical sensor, a weight sensor, etc. For example the control circuit is to calculate the required toner amount based on the toner amount detected by the sensor 19. For example the control circuit is to instruct the gate structure 33 to open when the detected toner amount in said region 19 is low and to open when the detected toner amount is high. For example the control circuit is a cartridge control circuit independent of a printer controller or formatter. For example the sensor 19 and gate structure 33 are controlled independent of a printer controller or formatter.

For example, the toner supply regulator 3 further includes a stirring device 35. For example the stirring device is to stir toner 30 in the reservoir 2 to stimulate flow of toner 30 out of the reservoir 2. For example the stirring device 35 includes a rotating profile. For example the control circuit is to instruct the stirring mechanism 35 to stop stirring when the required toner amount is determined to be low. For example the control circuit is to instruct the stirring mechanism 35 to stop stirring when the gate structure 33 is closed. For example the control circuit is to instruct the stirring mechanism 35 to stir when the required toner amount is determined to be relatively high. For example the control circuit is to instruct the stirring mechanism 35 to stir when the gate structure 33 is open.

According to the example of FIGS. 3 and 4 the gate structure 33 and stir device 35 are active only when a required toner amount is determined to be relatively high. In periods where the required toner amount is low, for example when printing low coverage pages, the gate structure 33 is closed and the stir device 35 remains static. The remaining toner particles 30 in the reservoir 2 is distanced from the region 18 of the toner supply roller assembly 20, hence reducing mechanical wear of the toner particles 30 during printing.

Figure 5:
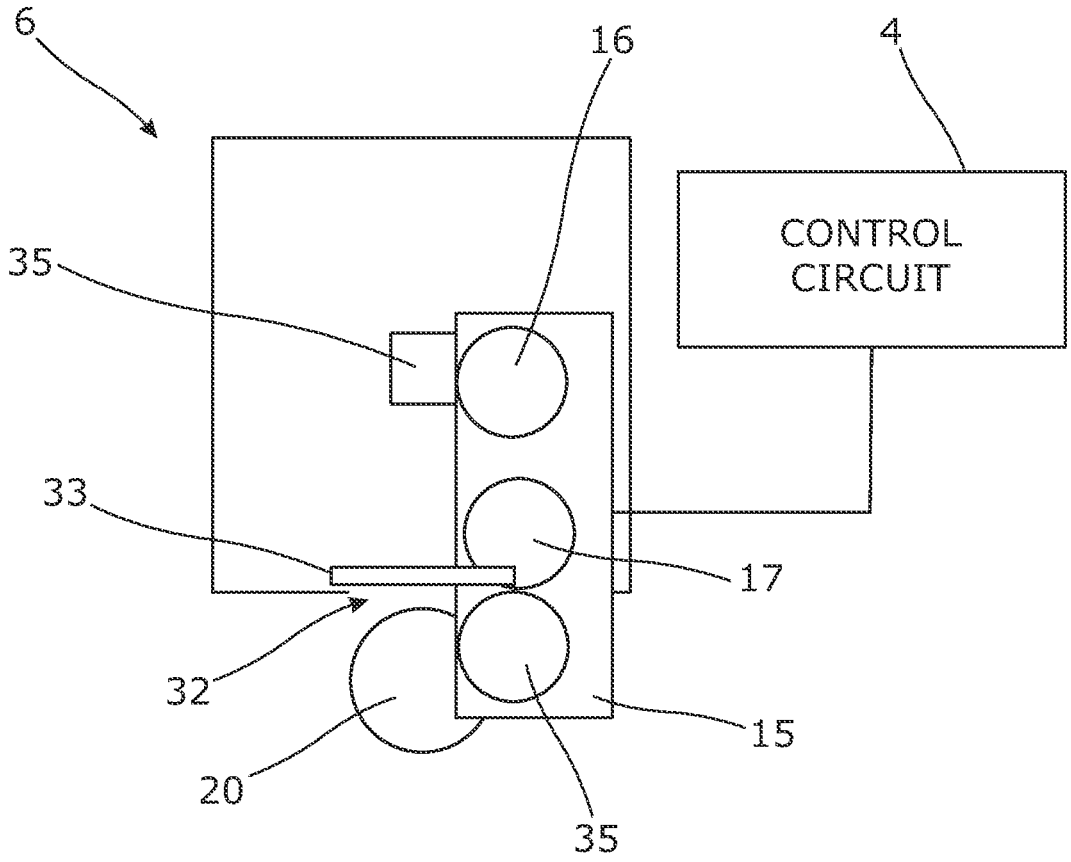
FIG. 5 illustrates a diagram of an example of a toner cartridge.

As diagrammatically illustrated in FIG. 5, in an example the cartridge 6 includes a transmission such as a gear train 15. For example, the control circuit 4 is to instruct the printer and/or gear train 15 so that respective toner supply roller assembly 20 or regulator parts 33, 35 are set in motion. For example in an installed condition of the cartridge 6 the gear train 15 engages corresponding printer drive or printer transmission elements to transmit movement of the printer drive to the stir device 35 and/or a toner supply regulator 33. For example the gear train 15 includes a stir device gear 16 for actuating the stir device 35, and a gate gear 17 for actuating the gate structure 33. For example, the stir device gear 16 and the gate gear 17 are part of the same cartridge gear train for driving both the gate structure 33 and the stirring mechanism 35, as instructed by the control circuit.

Figure 6:
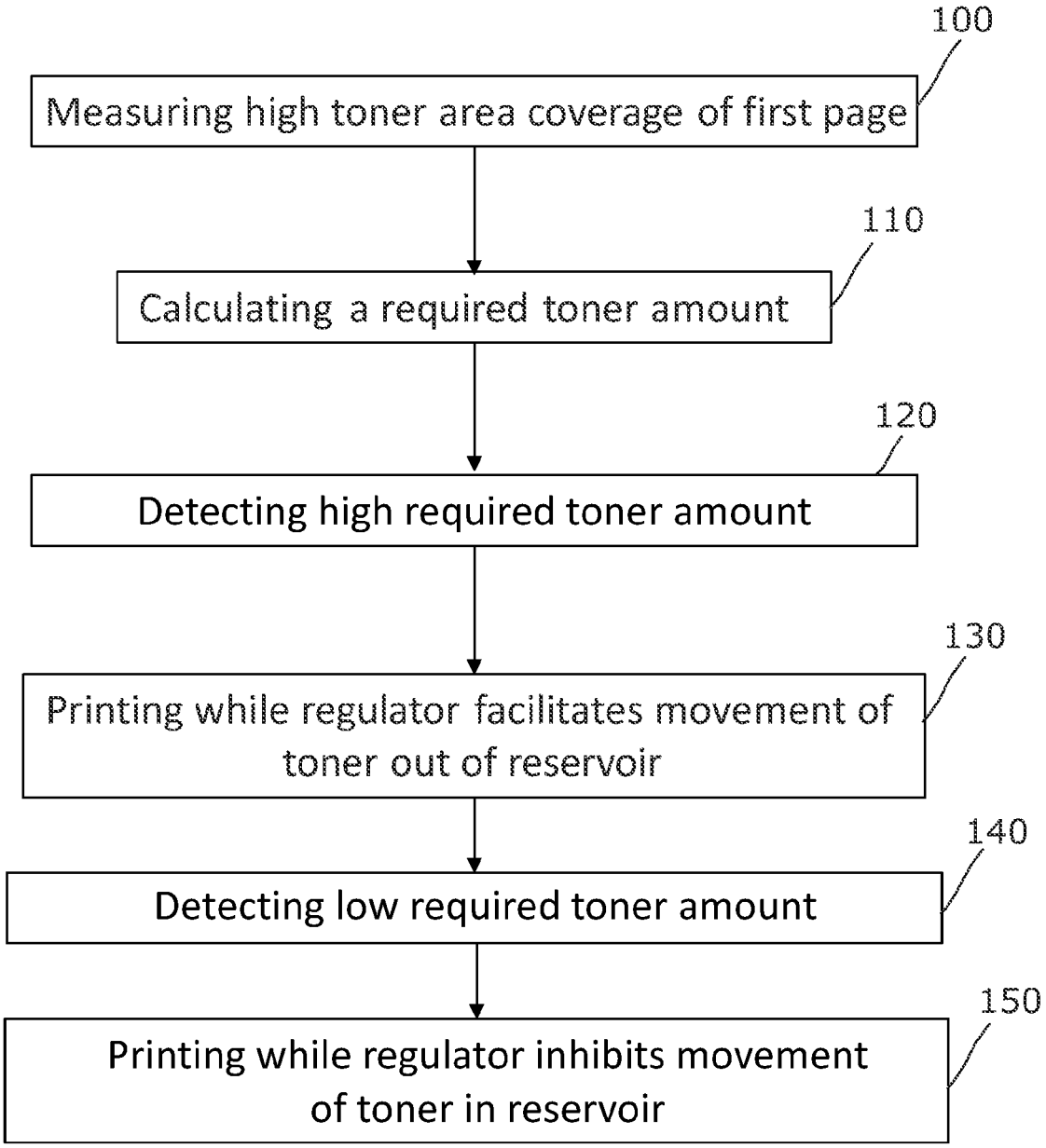
FIG. 6 illustrates a flow chart of an example of a method of printing.

FIG. 6 illustrates a flow chart of an example of a method of printing. For example the method includes measuring a toner amount (block 100). For example a toner amount in or near the toner supply roller assembly 20 is measured and/or toner amounts being printed are measured. Different sensing systems can be used to measure these toner amounts, as mentioned in the description. For example, the method includes calculating a required toner amount (block 110) based on the measured toner amount. For example coverage is calculated based on the toner amount measurements.

For example, the method includes detecting a relatively high required toner amount (block 120). For example the method includes printing a first page while a toner supply regulator 3 stimulates movement of toner out of a reservoir 2 (block 130). For example, the gate structure 33 is open and/or the stir device 35 stirs, stimulating the flow of dry toner to the toner supply roller assembly 20.

For example, the method includes detecting a relatively low required toner amount (block 140). For example, the method includes printing the second page while the toner supply regulator 3 inhibits movement of toner in the reservoir 2 (block 150). For example, the gate structure 33 is closed and/or the stir device 35 does not stir. For example, during printing, toner particles 30 in the reservoir 2 are prevented from wearing.

Figure 7:
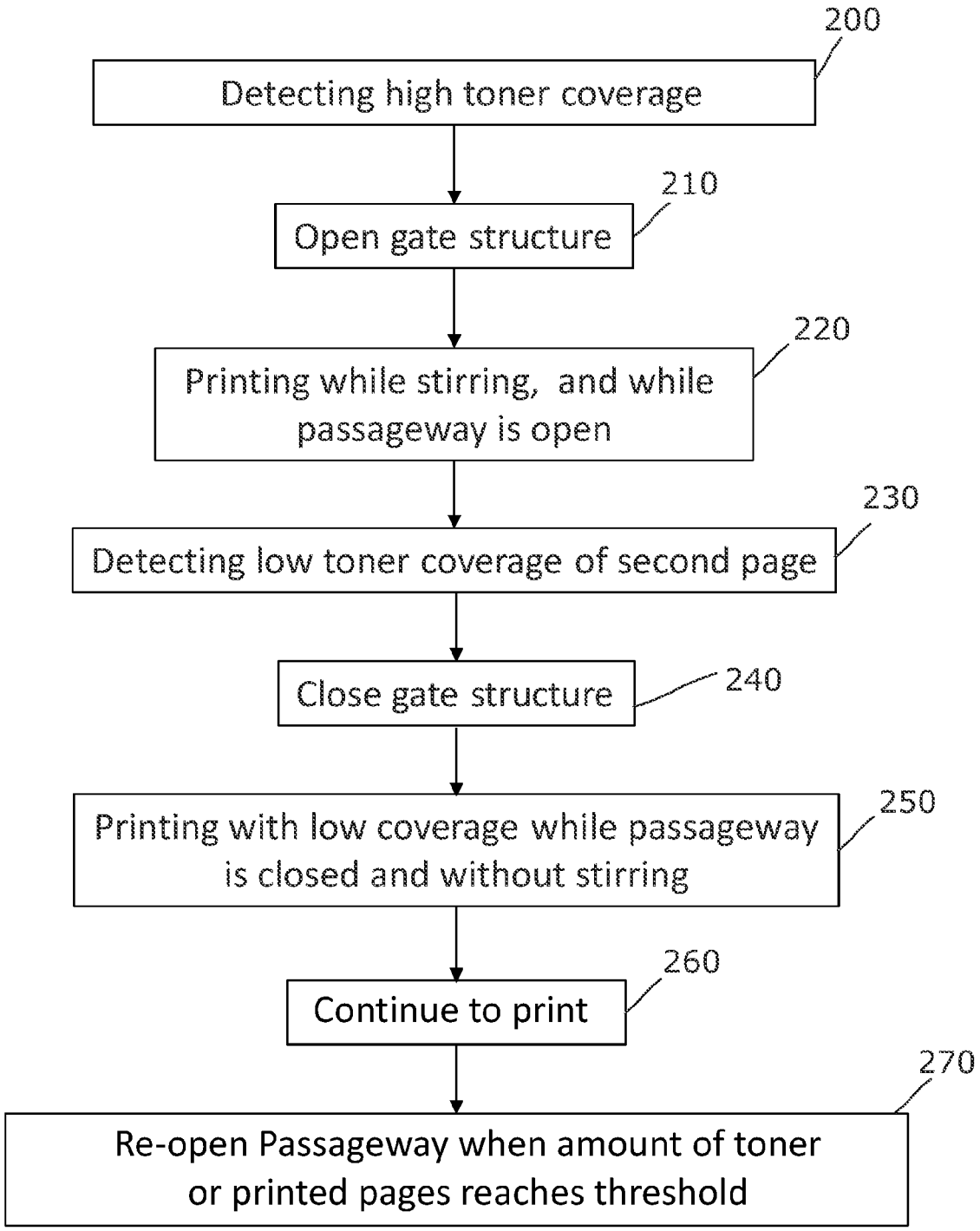
FIG. 7 illustrates a flow chart of another example of a method printing.

FIG. 7 illustrates a flow chart of another example of a method of printing. For example the method includes detecting a relatively high required toner amount (block 200). For example the method includes detecting relatively high toner coverage of a page, or a low amount of toner present in or near the toner supply roller assembly 20. For example the method includes opening the passageway 32 to allow toner to pass to the toner supply roller assembly 20 (block 210). For example the method includes printing while the toner passageway 32 is open and while stirring toner in the reservoir 2 when the relatively high toner amount is required (block 220). For example the method includes detecting a relatively low required toner amount (block 230). For example the method includes detecting relatively low toner coverage of a second page, or a high amount of toner present in or near the toner supply roller assembly 20. For example the method includes closing the passageway 32 to prevent that further toner 30 in the reservoir 2 moves to the toner supply roller assembly 20 (block 240). For example, the method includes printing while the passageway 32 is dosed and without stirring, so that movement of the toner 30 in the reservoir 2 is prevented, when relatively low toner amounts are required (block 250). For example, the method includes continuing to print low coverage pages after dosing of the passageway 32 (block 260). For example, the method includes re-opening the passageway 32 when despite of printing low coverage pages, the toner 30A in the toner supply roller assembly 20 is detected to be low. For example, the method includes re-opening the gate structure 33 when at least one of (i) an amount of printed pages and (ii) toner in the region 18 near the developer roller is determined to have reached a threshold (block 270), for replenishing the toner supply roller assembly 20.

In known dry toner print systems and cartridges, toner particles may wear before being printed on pages, by squeezing and stirring inside the cartridge. Some of the examples of this disclosure help to isolate toner particles from the areas of the cartridge 6 where mechanical wear occurs, until such time that they are actually needed to generate images. In one example the toner cartridges includes a toner of a particular color such as cyan, magenta, yellow or black, and the gate structure opens when that particular color is needed to generate images. Various techniques are available to estimate a toner amount (consumed or needed) to determine when to open the passageway 32 to the toner supply roller assembly 20. In yet another example the gate structure 33 is to periodically open, and for example opens more frequently during periods of high toner usage.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or an does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

What is claimed is:

1. An electro-photographic print system, comprising:

a toner reservoir, a toner supply roller assembly, a photoconductor roller;

a toner supply regulator regulating the supply of toner from the reservoir to the toner supply roller assembly, and a control circuit:

to calculate a toner amount required by the toner supply roller assembly based on a sum of times that a laser is applied to the photoconductor roller, and to instruct the toner supply regulator to adjust a toner amount downstream of the toner supply regulator based on the calculated required toner amount.

2. The print system of claim 1, the regulator comprising a gate structure to open and close a toner passageway from the toner reservoir to the toner supply roller assembly.

3. The print system of claim 2, wherein the gate structure is located near the toner supply roller assembly.

4. The print system of claim 2, the toner supply roller assembly comprising a toner re-supply roller for supplying toner to a developer roller, the gate structure being arranged near the toner re-supply roller, between the reservoir and the toner re-supply roller.

5. The print system of claim 2, comprising a toner amount sensor to detect the toner amount downstream of the gate structure.

6. The print system of claim 5, the toner supply roller assembly comprising a developer roller, wherein the sensor is to detect a toner amount in a region between the gate structure and the developer roller.

7. The system of claim 2, the regulator further comprising a stirring mechanism wherein the control circuit is to instruct to stop stirring when the gate structure closes the passageway.

8. The system of claim 2, comprising a gear to actuate the gate structure, wherein the control circuit is to instruct the gear.

9. The system of claim 8, the gear is part of a cartridge gear train.

10. The system of claim 9, the regulator further comprising a stirring mechanism, wherein the gear train is to drive the gate structure and the stirring mechanism.

11. The print system of claim 1, wherein calculating the required toner amount includes calculating at least one of toner coverage of at least one printed page, and toner coverage of at least one to be printed page.

12. The print system of claim 1, the toner reservoir containing dry toner particles.

13. The print system of claim 1, comprising a toner cartridge to be exchanged by an end user, wherein the toner reservoir and the toner supply regulator are parts of the toner cartridge.

14. A method of printing, comprising:

measuring a toner amount downstream of a toner supply regulator, calculating a required toner amount to print, detecting a relatively high required toner amount and consequently printing while the toner supply regulator stimulates movement of toner out of a reservoir and downstream to a roller assembly, detecting a relatively low required toner amount and consequently printing while the toner supply regulator inhibits movement of toner in the reservoir; wherein:

after detecting a relatively high required toner amount, printing while stirring toner in the reservoir, and after detecting a relatively low required toner amount, printing without stirring.

15. The method of printing of claim 14, wherein the calculating of the required toner amount to print includes calculating toner coverages of respective pages of a print job.

16. The method of printing of claim 14, comprising calculating the required toner amount based on the detected toner amount in or near a toner supply roller assembly.

17. The method of claim 14, comprising after detecting a relatively high required toner amount, opening a passageway from the reservoir to a toner supply roller assembly, printing while the passageway is open, after detecting a relatively low required toner amount, closing the passageway, and printing while the passageway is closed.

18. The method of claim 17, comprising detecting a toner amount in or near the toner supply roller assembly, calculating a required toner amount based on said detected toner amount.

19. The method of claim 18, comprising detecting the toner amount near a developer roller.

20. An electro-photographic print system, comprising:

a toner reservoir, a toner supply roller assembly comprising a photoconductive roller, a laser, a toner supply regulator regulating the supply of toner from the reservoir to the toner supply roller assembly, the regulator comprising a gate structure to open and close a toner passageway from the toner reservoir to the toner supply roller assembly, the regulator further comprising a stirring mechanism upstream of the gate structure, and a control circuit:

to calculate a toner amount required by the toner supply roller assembly based on the sum of the times that the laser is applied to the photoconductive roller, and to instruct the toner supply regulator to supply toner to the toner supply roller assembly based on the calculated required toner amount.

21. The print system of claim 20, wherein the control circuit is to instruct the stirring mechanism to stop stirring when the gate structure closes the passageway.

* * * * *